US005178384A

United States Patent [19]

Gorman

[11] Patent Number: 5,178,384

[45] Date of Patent: Jan. 12, 1993

[54] COLLAPSIBLE SPORTS PRACTICE DEVICE

[76] Inventor: Thomas E. Gorman, 19 Eames St., North Reading, Mass. 01864

[21] Appl. No.: 755,075

[22] Filed: Sep. 5, 1991

[51] Int. Cl.[5] ..... A63B 69/40

[52] U.S. Cl. ..... 273/26 A; 273/410; 135/87; 135/90; 135/109

[58] Field of Search ..... 273/26 A, 29 A, 181 F, 273/410, 26 R, 127 B; 135/87, 89, 88, 120, 101, 106, 108, 109, 111, 112, 90, 107

[56] References Cited

U.S. PATENT DOCUMENTS

| | | | |
|---|---|---|---|
| 849,941 | 4/1907 | Titus . | |
| 1,129,194 | 2/1915 | Hanley | 135/107 |
| 1,405,081 | 1/1922 | Whitney | 273/181 F |
| 1,540,670 | 6/1925 | Vidmer | 273/410 |
| 2,126,102 | 8/1938 | Fowler . | |
| 2,827,295 | 3/1958 | Austin . | |
| 2,839,300 | 6/1958 | Blaha et al. . | |
| 2,922,653 | 1/1960 | O'Brien | 273/410 |
| 3,184,235 | 5/1965 | Hilbrich . | |
| 3,288,159 | 11/1966 | Corliss | 125/120 |
| 3,408,071 | 10/1968 | Lundy . | |
| 3,475,025 | 10/1969 | Uphaus . | |
| 3,593,997 | 7/1971 | Boehner | 135/87 |
| 3,707,977 | 1/1973 | Grady | 135/107 |
| 3,856,301 | 12/1974 | Davidson . | |
| 3,997,158 | 12/1976 | Britton . | |
| 4,066,089 | 1/1978 | Rainwater | 135/109 |
| 4,127,267 | 11/1978 | Bay et al. . | |
| 4,556,219 | 12/1985 | Tillery | 273/181 F |
| 4,732,382 | 3/1988 | Ratner | 273/29 A |
| 4,768,784 | 9/1988 | Wilson . | |
| 4,926,892 | 5/1990 | Osmonson | 135/112 |
| 4,969,651 | 11/1990 | Comaritan | 273/410 |

FOREIGN PATENT DOCUMENTS

| | | | |
|---|---|---|---|
| 3425145 | 3/1985 | Fed. Rep. of Germany | 135/87 |
| 407045 | 3/1934 | United Kingdom | 273/181 F |
| 408944 | 4/1934 | United Kingdom | 273/181 F |

*Primary Examiner*—Theatrice Brown
*Attorney, Agent, or Firm*—Testa, Hurwitz & Thibeault

[57] ABSTRACT

A portable, collapsible practice device which forms an enclosure for containing balls which are pitched, hit, kicked or batted into the enclosure is described. The device is attached to and supported by a permanent backstop or other structure at the practice area. The device comprises a pair of frame members comprising pivotally connected support, netting or other foldable material which is suspended from and between the supports thereby forming the enclosure, means for attaching one end of the supports to the permanent structure and wires or ropes for maintaining the rigidity of the device.

5 Claims, 6 Drawing Sheets

COLLAPSIBLE SPORTS PRACTICE DEVICE

BACKGROUND OF THE INVENTION

Practice cages have long been known for containing baseballs hit during practice sessions, and for other ball sports. For open field use, portable batting cages are used.

Attempts have been made to provide an inexpensive, convenient and portable device for containing balls which are hit, pitched or batted during practice sessions for various sports. However, previously proposed devices are too cumbersome and costly or are not easily portable.

A free-standing sport practice cage is described in U.S. Pat. No. 3,593,997, for example, which is an enclosed practice cage having sliding panels in front which adjusted so that the size of the front opening of the cage can be varied.

A portable backstop for use in baseball or softball is described in U.S. Pat. No. 3,475,025. This device consists of a free-standing frame having back and top portions and two side portions.

Another portable cage is described in U.S. Pat. No. 4,969,651. This device is a free-standing frame consisting of side and top panels of a flexible material which is supported by struts or poles at the corners.

A backstop consisting of a free-standing sideless frame and having a back netting for arresting balls in flight is described in U.S. Pat. No. 4,127,267.

A free-standing wheeled backstop which can be disassembled after use is described in U.S. Pat. No. 2,827,295.

A wheeled backstop which can be folded together after use is described in U.S. Pat. No. 3,408,041.

The above practice cages and backstops suffer from several disadvantages. They are either unwieldy, costly, heavy, difficult for one person to assemble or disassemble and/or too small.

It is an object of this invention to provide a very economical, lightweight, portable, collapsible practice cage which can be easily and quickly erected and disassembled by one person.

SUMMARY OF THE INVENTION

The invention relates to a portable collapsible sports practice device comprising an enclosure for containing balls which are hit, kicked, pitched or batted into the enclosure. The present device comprises a pair of frame members or supports, each comprising rigid elongate members which are pivotally connected so that the members can pivot relative to each other. The members are separated and disposed angularly relative to each other when the device is set up, and collapse together for storage. The device is designed to attach to a permanent structure, for example, in a ball field or gymnasium. The device utilizes the permanent structure, which is generally a chain link fence or backstop, to support the frame members. For this purpose, means for attaching the device to a permanent structure are attached to one end of the frame members.

The frame members have attached thereto a flexible material such as netting, canvas cloth or other material to contain the balls which are hit, thrown, pitched or kicked into the enclosure. The material is suspended between the set of frame members across the top of the enclosure. Other sheets drape downward on two sides from the frame members, and across the back suspended between the set of frame members. Thus, the enclosure can be surrounded on up to four sides by the material and has an open front.

Lines are included which run from the corners of the frame members and the netting to the permanent structure to maintain tension on the frame members and netting in order to provide shape and rigidity to the enclosure. The lines can be ropes, wires or chains, for example. Rigid rods or tubes can also be used for this purpose.

A pair of shorter members can be included for securing the bottom of the net in proximity to the ground or floor. These members are attached to each back bottom corner of the net and removably attach to the permanent structure in such a manner that they exert downward force on the corners, thereby keeping the back of the net in contact with or in close proximity to the ground. Alternatively, the lower corners can be weighted, or secured with stakes in the ground.

In another embodiment of the present device, a canopy for preventing balls which are hit upward from leaving the ball field is provided. This embodiment comprises a pair of single rigid frame members containing attachment means for attaching the members to the permanent structure and having netting between the two members. The resulting structure, when erected, forms an awning or canopy which prevents balls which are hit or batted upward by a person standing under the awning from going over the top of the permanent backstop or fence and leaving the ball field. This embodiment can optionally include side and/or back netting to restrict the flight of the balls further, thereby keeping them within easy reach. If a back or side netting is included, members for securing the bottom corners of the netting to the ground, as described above, can be included. The device can further contain pulleys for mounting the awning on the permanent structure, and lines for securing it to the structure.

The present device has several advantages. The entire assembly is durable, lightweight and inexpensive. The device can be set up by one person in minutes, without tools. When the practice session is over, the lines and frame members are detached from the permanent structure, and the frame members are folded together with the netting to form a compact bundle. The entire device can then be carried away and stored in a small space.

BRIEF DESCRIPTION OF THE DRAWINGS

Similar characters of reference represent corresponding parts in each of the several views.

DETAILED DESCRIPTION OF THE INVENTION

The device of the present invention provides convenience and safety in practicing batting in baseball or softball, or in hitting, pitching or kicking in other sports. The present device is unique in that it uses a pre-existing, permanent chain-link fence or other structure for structural support. Most ball fields contain a permanent backstop, which is usually a chain-link structure, which can be used to support the present device.

Figure 1:
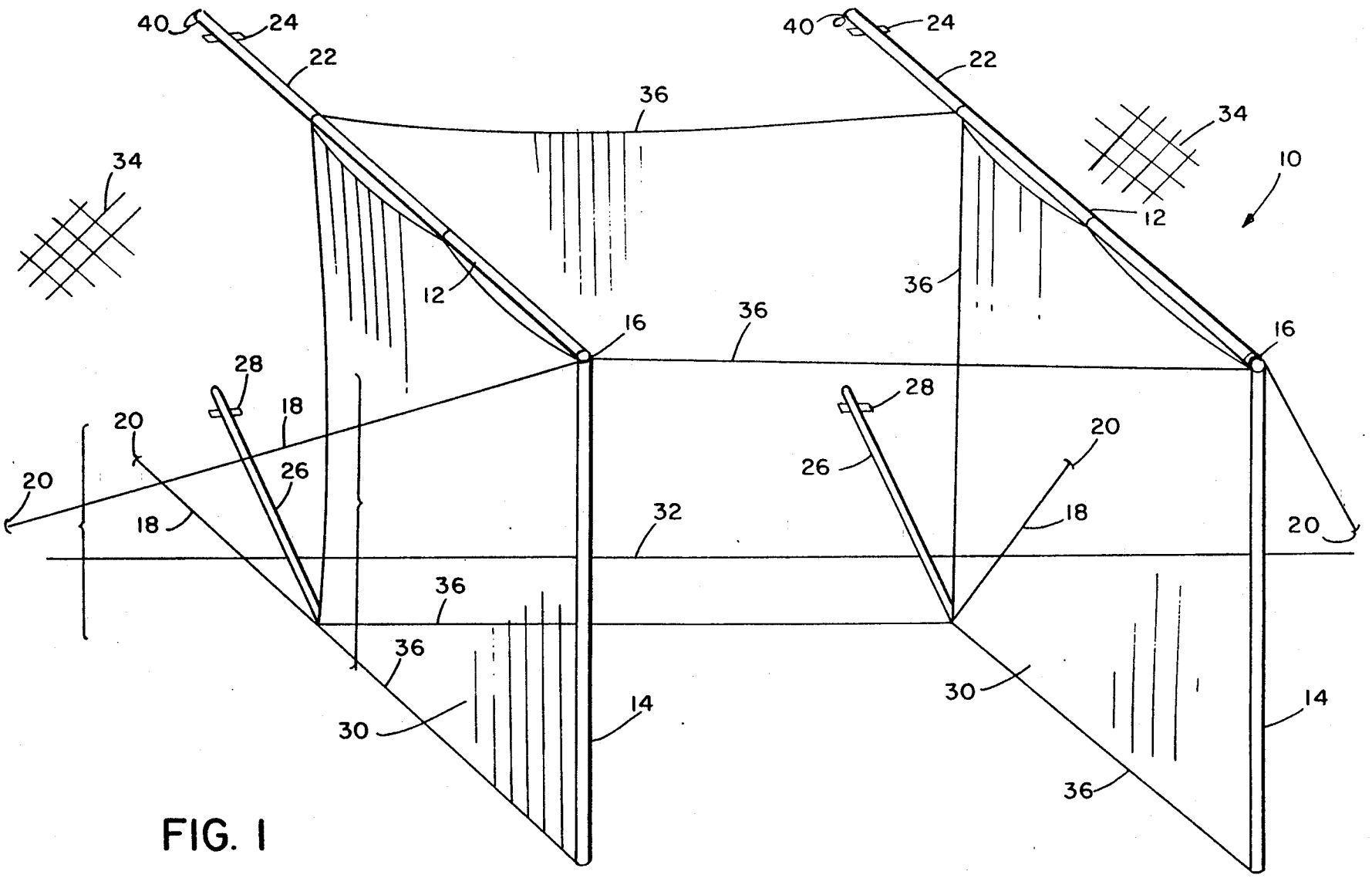
FIG. 1 is a perspective view of a sports practice device of the present invention having an open front and netting on four sides, and which is attached to a permanent chain-link structure.

Referring now to the drawings, FIG. 1 illustrates an exemplary embodiment of the present device as it is set up for use. As shown in FIG. 1, the present device 10 comprises a pair of frame members comprising rigid elongate members 12, 14 which are connected via a hinge or pivot 16. One end of member 12 opposite the pivot end includes attachment means 40 for removably attaching the member 12 to a permanent structure 34, which is preferably a chain-link fence, or backstop. In the preferred embodiment shown in FIG. 1, attachment means 40 is located at the end of an extendable member 22 which telescopes or extends from the non-pivot end of members 12 to the backstop 34, so that the back, of the enclosure is spaced from the backstop 34. Extendable members 22 preferably telescope into the hollow interior of support 10. However, extendable members 22 alternatively can be permanently attached to members 12 with a hinge or pivot and locked into place during use, or temporarily attached using clips or snaps, for example. The extendable members 22 preferably includes crosspiece 24 which prevents member 22 from proceeding through the links in backstop 34. Attachment means 40 is located at the distal end of member 22 and physically attaches the member to the fence. Member 22 together with members 12, define the top support for the enclosure.

Members 14 are preferably disposed angularly to members 12 when the enclosure is set up for use, as shown in FIG. 1. That is, the members 12, 14 are disposed so that the two members are oriented relative to each other forming an angle such that a stable enclosure is formed. Members 14 define the front of the enclosure.

The enclosure shown in FIG. 1 has an open front, and top, back and sides which are formed from a foldable material 30 such as netting, canvas cloth or the like. Netting is preferred due to its light weight, transparency to light and low wind resistance. As shown in FIG. 1, the material 30 is attached to frame members 12 and 14, and forms the sides, top and back of the enclosure. The material is suspended between the frame members by rings, ties or other means along edges 36. Edges 36 form the finished edges of the material 30, and can represent a hem, bend or seams in the material 30.

The corners of the netting or other material 30 are held in contact with or in proximity to the ground during use by rigid members 26. Members 26 are attached to the backstop or fence 34 in such a manner that they exert a downward force on the back lower corners of the material 30. Members 26 can included crosspieces 28 which prevent members 26 from proceeding through the holes in the chain link fencing, and can optionally contain attachment means 40 for securing the member to the fence 34.

Figure 2:
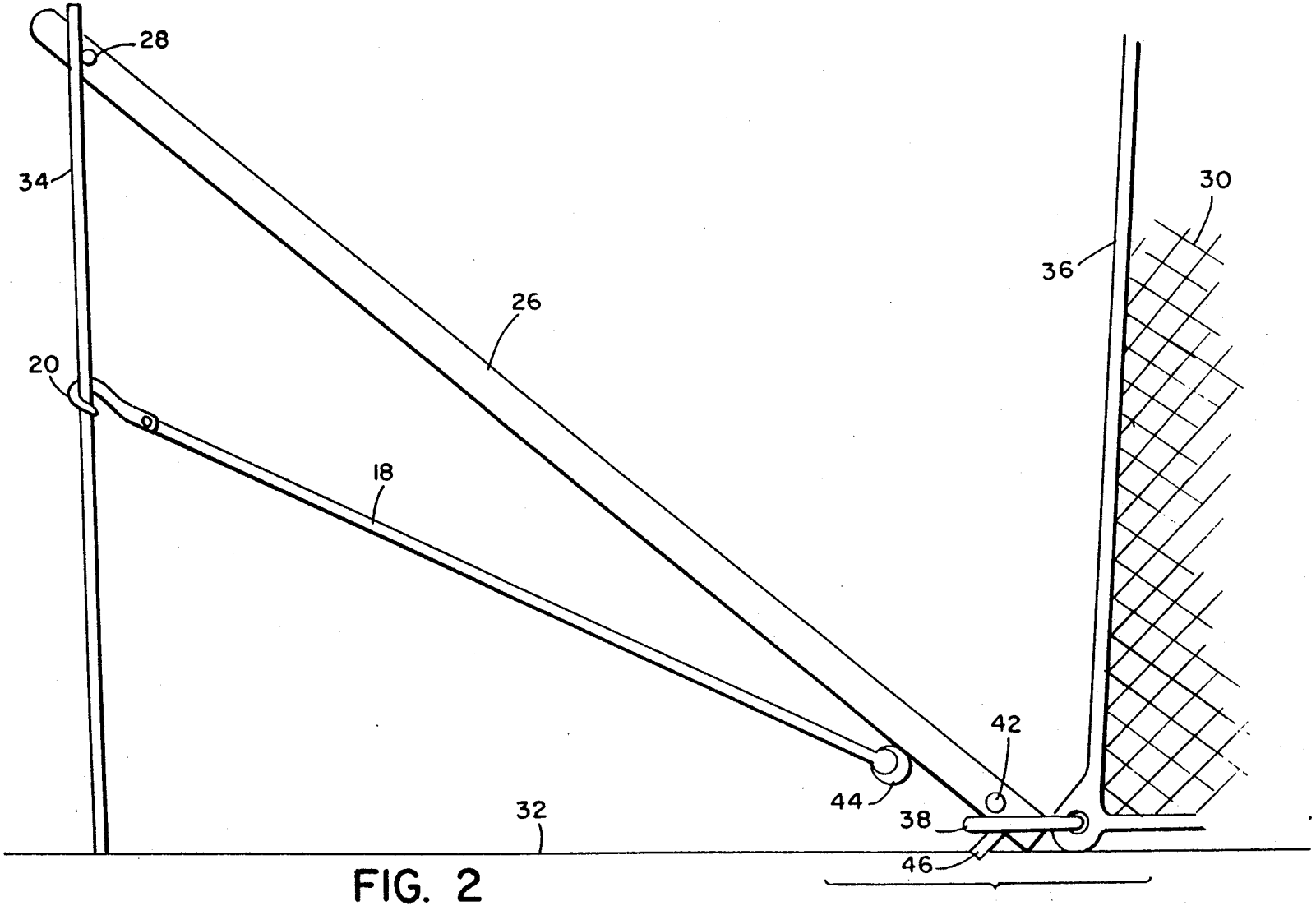
FIG. 2 is a partial, exploded side view of a rear corner of the device, which is bracketed in FIG. 1, showing the connection between the corner of the netting and a frame member which keeps it in proximity to the ground.

Members 26 are shown in more detail in FIG. 2. In the embodiment shown in FIG. 2, member 26 is connected to the net edge 36 via a ring 38 which is permanently attached to edge 36. Member 26 is removably connected to ring 38 such that attachment means 46, which in this embodiment is a pin, hooks under the ring. The configuration of pin 46 is shown in more detail in FIG. 3. Crosspiece 42 prevents the ring 38 from sliding up member 26. Crosspiece 28 prevents member 26 from proceeding through the links in the fence. The member 26 is inserted into the chain-inks of fence 34 in such a manner that crosspieces 28 are in intimate tension-bearing contact with the fence, causing the other end which is secured to ring 28 to press into the ground, the plane of which is represented by line 32. When in place, member 26 exerts downward pressure on ring 38 which serves to keep the back lower corners of the device 10 in contact with or in proximity to the ground.

The present device is secured in place and held rigid by lines, wires, chains or ropes, which are referred to herein generally as lines. The lines can also be rigid rods or tubes. The lines 18 are attached to the front top corners and back lower corners of the enclosure and run to the permanent structure 34. The lines 18 are removably secured to structure 34 so that tension is maintained on the lines 18 thereby holding the enclosure in place. As shown in FIG. 1, lines 18 preferably run from the front top corners and the rear lower corners of the enclosure to the permanent structure 34. Lines 18 have attachment means 20 for removably attaching them to the permanent structure 34.

Figure 3:
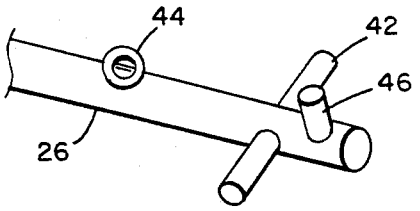
FIG. 3 is an exploded view of the bracketed section of FIG. 2, showing the configuration of the attachment means for securing the netting to the frame member.
Figure 4:
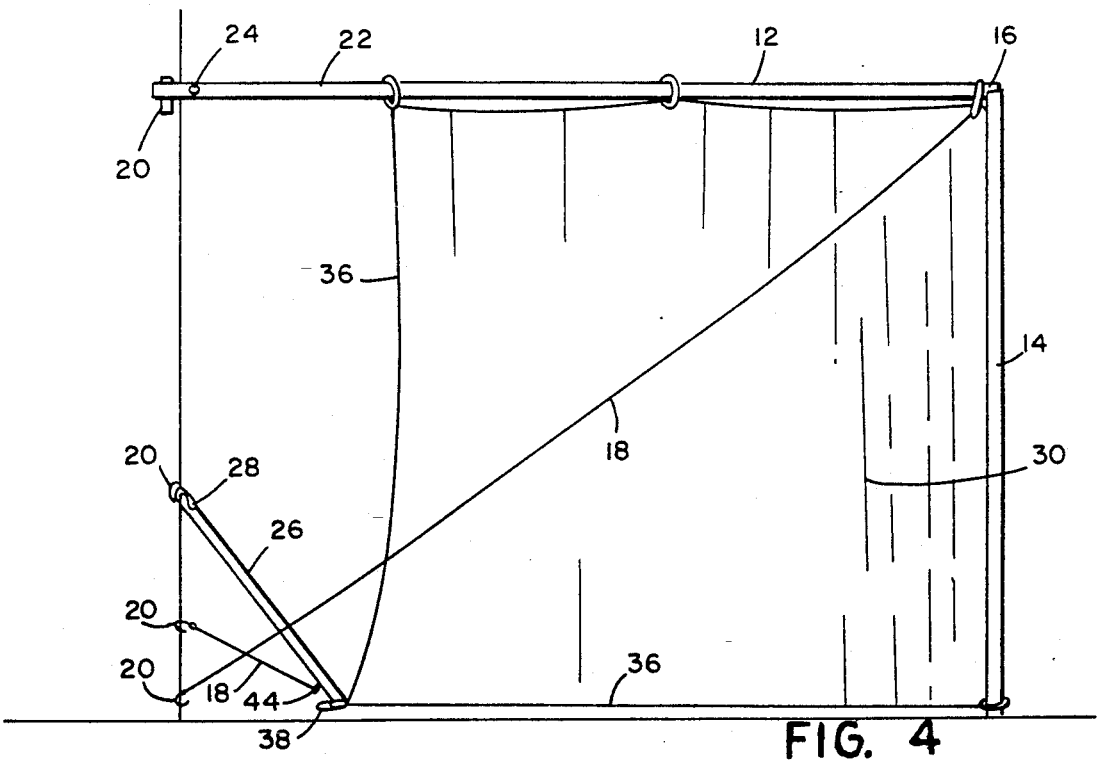
FIG. 4 is a side view of the device shown in FIG. 1.

The lines 18 holding the lower rear corners of device 18 are shown in more detail in FIG. 2. In the embodiment shown in FIG. 2, line 18 is attached to member 26 via a ring 44 which is an integral part of member 26. Line 1 8 runs between member 26 and the permanent structure 34 and is attached to permanent structure 34 by attachment means 20. Attachment means 20 can be a hook as shown in the embodiment shown in FIG. 2, or can be a tee, clip, pin or other removable attachment means. An exploded view of the end of member 26 is shown in FIG. 3, illustrating the details of the pin arrangement 42 and attachment means 46. FIG. 4 shows a side view of the embodiment of FIG. 1, and more clearly shows lines 18 extending from the top front and rear lower corners of the device 10 to the structure 34.

Once erected, the resulting device 10 provides in one aspect, a box-shaped cage with an open front, and two sides, back and top of material 30 which is able to contain a pitched, hit, kicked or batted ball. The material, which is preferably netting, absorbs the impact of a ball that is pitched or hit into it, and the ball generally comes to rest within the enclosure.

Figure 5:
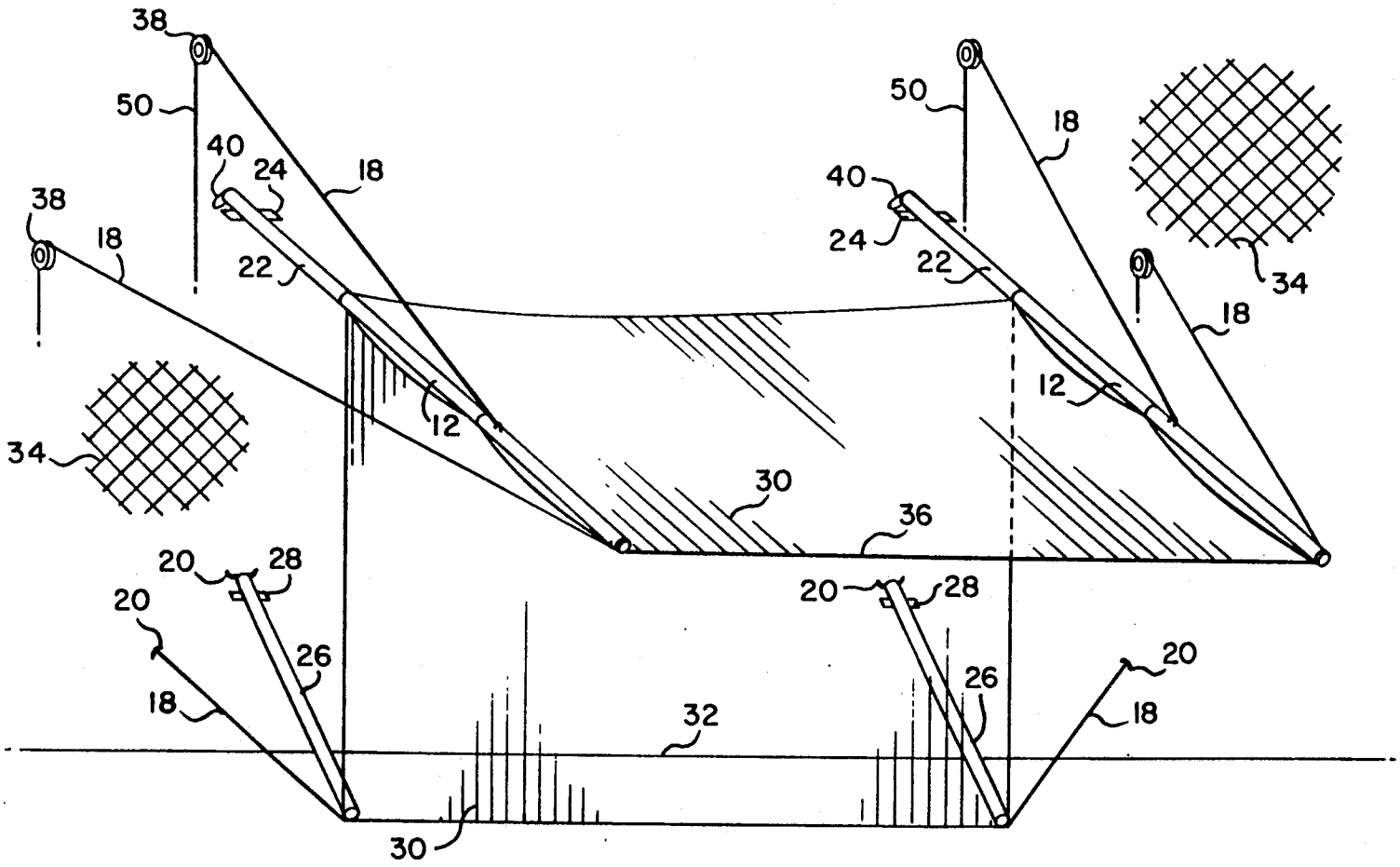
FIG. 5 is a perspective view of a sports practice device of the present invention having an open front and sides, and having back and top netting, which is attached to a permanent chain-link structure.
Figure 6:
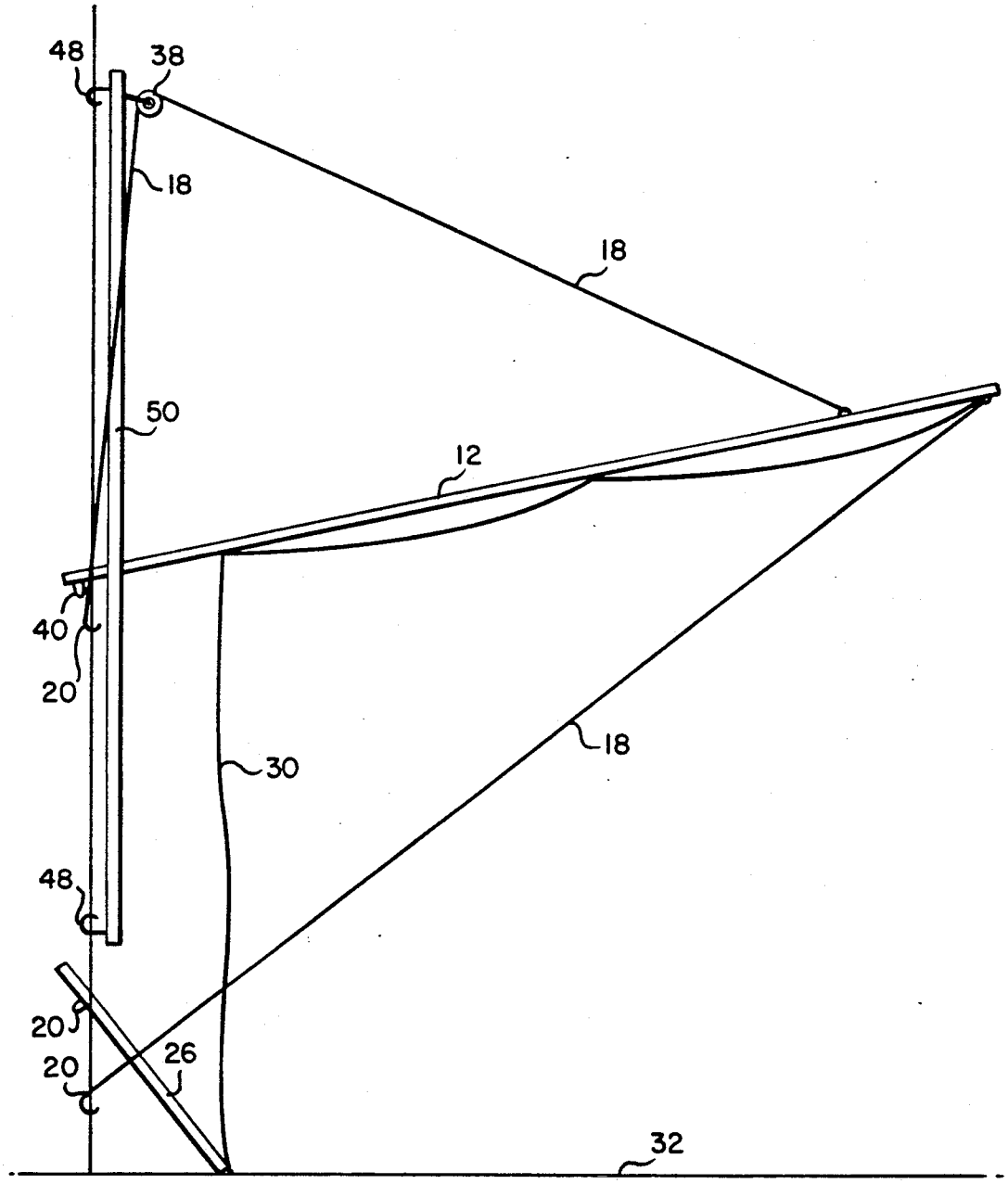
FIG. 6 is a side view of the embodiment shown in FIG. 5 showing details of the pulley arrangement.

In another embodiment, shown in FIGS. 5 and 6, the device has an overhead canopy that prevents the pitched/batted ball from going over and behind the permanent fence or backstop 34. The device in this embodiment contains a pair of top frame members 12, but lacks front frame members 14. The netting for the back or sides may be supplied or not. This embodiment provides an awning or canopy, suspended from the permanent structure.

The frame members 12, 14, 22 and 26 can be fabricated from any rigid, lightweight, durable material; for example, metal, fiberglass, graphite, wood or a rigid plastic. The members are preferably tubular and made of metal, preferably steel or aluminum. Members 12 and 14 are generally from about 10 to about 14 feet long. Members 22 and 26 are generally about 5 to about 6 feet long.

The foldable material 30 can be any flexible, weather resistant material such as nylon netting or canvas cloth. Netting is preferred due to its light weight, transparency to light and low wind resistance.

The lines 18 can be any strong, light line such as wire or nylon cord, for example. Line 18 can also be fabricated from rope, chain or can be rigid rods or tubes.

The attachment means 20 and 40 can be any removably attachable article which allows the frame member or line to which it connected to be temporarily secured to a chain-link fence or other permanent structure, and can be easily removed when the device is disassembled. Such articles can include, for example, hooks, tees, pins, clamps, eyes or clips. Although the present device attaches readily to chain link structures, it can alternatively be attached to another permanent structure, for example, inside a gymnasium. The structure may have a solid -facade. The device requires only six or eight fixtures mounted on the structure to be erected and used there as well.

The enclosure does not require any assembly prior to use. The present device can be easily and quickly erected by one or two people at the site of use. The device is erected for use by unfolding the support members 12, 14 and hooking the attachment means 40, which are located at one end of members 12 or members 22, securely to one of the links in the permanent chain link backstop. This can be accomplished by holding the member 12 near its pivot end (where it is pivotally connected to member 14) and manipulating the attachment end to engage the attachment means 40 with the links in the fence. Attachment means 40 are preferably located on the end of extendable members 22, as shown in FIGS. 1 and 4. Once members 12 are attached to the backstop, members 14 are pivoted around hinge 16 until they are upright, preferably nearly perpendicular to members 12. The non-pivot ends of members 14 rest on the ground or floor. The netting 30, which is attached to members 12 and 14, is unfolded. When set up for use, members 12 and 14 are generally spaced about 12 to 14 feet apart. Lines 18 from front top corners are pulled taut, and secured to the permanent structure to impart rigidity to members 12 and 14. Netting attached to the members is unfolded and stretches between members 12 to form the top of the enclosure, and drapes down to form the sides and the back of the enclosure. The netting for the sides and back is optional and is preferably, but not necessarily, included in the enclosure. It is desired to keep the netting secured against the ground to prevent balls from rolling under it. For this purpose, support members 26 can be affixed to the chain-link backstop and secured to the lower rear corners of the device such that they exert downward pressure on the corners of the net. Finally, lines 18 from members 26 are pulled taut and attached to the fence in order to secure the lower rear of the netting. Alternatively, the lower corners of the netting can be weighted or secured by stakes. The enclosure is now ready for use.

Figure 7:
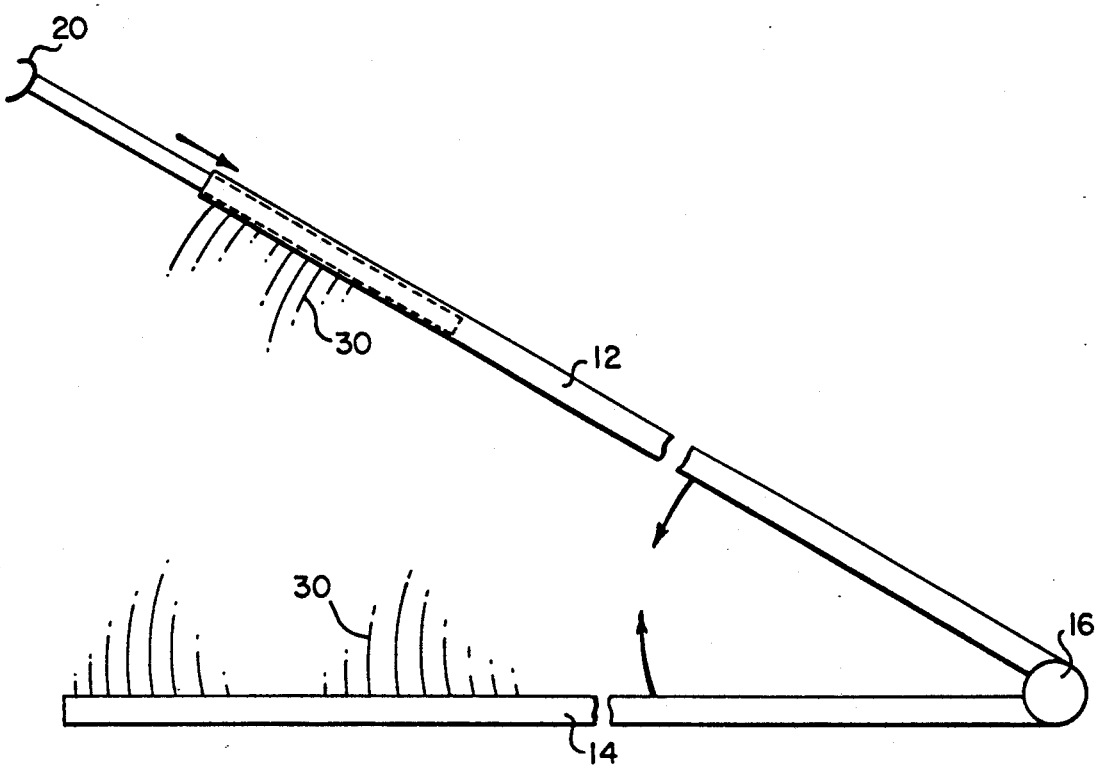
FIG. 7 is a side view illustrating the collapse of one of the pair of pivotal frame members.
Figure 8:
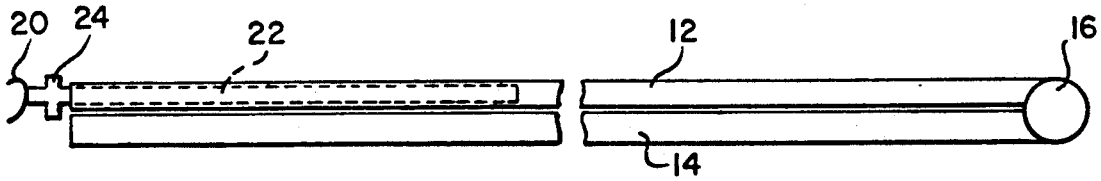
FIG. 8 is a side view illustrating the pivotal frame members of FIG. 6 in a completely collapsed position.

When the practice session is over, the process is reversed. The lines 18 are disconnected and members 26 are detached from the fence. Support members 14 are pivoted back, thereby lowering the pivot end of members 12 and bringing them within reach. Members 12 are then manipulated to release attachment means 40 from the fence. Members 12 and 14 are then folded together, as shown in FIG. 7. FIG. 8 shows members 12 and 14 in a completely closed position, with extendable member 22 telescoped into support 12. The net can then be folded together with members 26, lines 18 and the supports thereby forming a compact bundle for easy transport.

The procedure for erecting the canopy embodiment of the present device, shown in FIGS. 5 and 6, is slightly different from that for the cage configuration because the canopy embodiment lacks front members 14. This procedure involves extending members 22 from members 12 and manipulating members 12 to engage attachment means 40 with the chain-link backstop. To bring members 12 to their required height, pulleys 38 are provided. Pulleys 38 are removably attachable to the chain-link backstop, and are connected to members 12 by lines 18, as shown in FIG. 5. Lines 18 can then be pulled through the pulleys to exert force on members 12 until they are properly positioned. The pulley lines are then secured by attachment means 20 to maintain the desired tension, thereby holding members 12 in position. The arrangement of pulleys 38 is shown in more detail in FIG. 6. As shown, rod 50 can be included which is attached to pulley 38. The rod 50 allows pulley 38 to be attached to permanent structure 34 at an advantageous height without climbing the backstop, since the height at the point of attachment is typically greater than eleven feet. Rods 50 are removably attached to structure 34 by attachment means 48, which can be, for example, hooks, eyes, tees, pins, clamps or clips. Line 18 is pulled taut through pulley 38 to properly position member 12, then secured to structure 34 by attachment means 20. In another embodiment, "eyes" can be used in lieu of pulleys. In this embodiment, the lines pass through the eyes, which are attached to the fence, thereby holding members 12 in position. The process is reversed to disassemble the device.

The present device provides an easily assembled and portable structure for containing balls which are pitched, hit, kicked or batted into it. The present portable practice enclosure can eliminate the need for a catcher during batting practice. The enclosure keeps the missed and fouled pitches close enough to the batter so that the batter can easily retrieve the balls and return them to the pitcher.

The present device reduces the number of balls lost, a particularly acute problem because permanent backstops are often erected at an extreme corner of a ball field with the understanding that anything behind the backstop is out of bounds, and this often consists of trafficked streets where vehicles are at risk, or overgrown land where a dropped ball is difficult to find. Permanent backstops or similar structures in ball fields are generally not provided with an overhang sufficient to prevent the fouled ball from leaving the field area, because the space between home plate and the backstop is "in play" and such a canopy during games would interfere with the catcher's ability to field foul "pop-ups". The present invention prevents balls from going over the permanent backstop and out of the field.

Because the present device relies on the existing permanent backstop or fence for much of its support, it can be made of light and easily portable materials, and much more cheaply than existing models, which can weigh many hundreds of pounds, must be multi-wheeled, or require substantial storage area. Because of their massive size, most large batting cages are left outdoors, and their nets need to be replaced frequently, due to the effects of the elements, particularly the sun. These cages are also subject to vandalism.

Both versions of the present device can be carried by a single person, stored in minimal space, and both can be erected or collapsed by one or two individuals in minutes, without tools.

Equivalents

Those skilled in the art will recognize, or be able to ascertain, using no more than routine experimentation, several equivalents to the specific embodiments described herein. Such equivalents are considered to be within the scope of this invention, and are covered by the following claims.

I claim:

1. A collapsible sports practice device comprising:

a pair of spaced apart frame members, each frame member comprising a rigid elongated substantially horizontal member and a rigid elongated substantially vertical member and said horizontal member having one of its ends pivotally connected to the upper end of said vertical member;

a plurality of flexible panels supported by said frame members to define an enclosure having a closed rear end for preventing balls from entering and exiting said enclosure and an open front end for allowing balls to enter and exit said enclosure;

a pair of elongated rigid upper spacer members and a pair of elongated rigid lower spacer members for maintaining said device at a predetermined distance from a permanent structure, said upper and lower spacer members spacing said rear end from a said structure each said upper spacer member being attached to said horizontal member and having one of its ends engaging a said structure and each of said lower spacer members having one end engaging a said structure and its other end attached to a lower edge of said rear end of said enclosure and;

a pair of elongated lines for attaching said device to a said structure and for securing said lower edge each said line having one end attached to a said structure and its other end attached to and adjacent said other end of a said lower spacer member.

2. The collapsible enclosure of claim 1 wherein said horizontal members are tubular and said upper spacer members are telescopically received within said horizontal frame members.

3. The collapsible enclosure of claim 2 wherein said structure is a chain link fence having a plurality of openings therein and wherein each spacer member has a rigid cross piece attached at a right angle thereto and adjacent said one end for allowing said one end to proceed through a said opening a predetermined distance.

4. The collapsible device of claim 1 wherein said lower spacer members are positioned at an angle to exert a downward force on said rear end of said device.

5. A collapsible sports practice device comprising a pair of spaced apart frame members, each frame member comprising a rigid elongated substantially horizontal tubular member and a rigid elongated substantially vertical member and said horizontal member having one of its ends pivotally attached to the upper end of said vertical member;

a plurality of flexible panels supported by said frame members to define an enclosure having upper and lower edges, a closed rear end for preventing balls from entering and exiting said enclosure and an open front end for allowing balls to enter and exit said enclosure;

a pair of elongated rigid spacer members and a substantially vertically extending stationary chain-line fence, said fence having a plurality of spaced apart openings therein, the longitudinal axis of said spacer member being longitudinally adjustable along the longitudinal axis of said horizontal member for allowing adjustment of the distance between the other end of said spacer member relative to said rear end of said enclosure said spacer member having a cross piece attached to a right angle thereto and adjacent said other end thereof; said cross piece preventing said spacer member from proceeding through said fence when said other end is inserted into one of said openings thereby positioning said rear end of said enclosure a predetermined distance from said fence;

means attached to said lower edge of said enclosure for exerting a downward force on said flexible panel and for anchoring said enclosure to a support surface at said predetermined distance from said fence and means for attaching said one end of said spacer member to said fence once said one end has been inserted through said opening.

* * * * *